United States Patent [19]

Haytayan

[11] 4,330,922

[45] May 25, 1982

[54] ASSEMBLY AND METHOD OF ATTACHING TO INGOT MOLD

[75] Inventor: Harry M. Haytayan, Lincoln, Mass.

[73] Assignee: Pneutek, Inc., Hudson, N.H.

[21] Appl. No.: 215,225

[22] Filed: Dec. 11, 1980

[51] Int. Cl.[3] ..... B22D 7/10; B23P 11/00

[52] U.S. Cl. ..... 29/432; 29/526 R; 164/1; 249/197

[58] Field of Search ..... 164/1, 137; 249/197–202, 106, DIG. 5; 29/526 R, 432

[56] References Cited

U.S. PATENT DOCUMENTS 3,436,883 4/1969 Charman, Jr. et al. ..... 164/137 X 4,131,262 12/1978 Bowers ..... 249/202

FOREIGN PATENT DOCUMENTS 1376944 12/1974 United Kingdom ..... 249/197

*Primary Examiner*—R. L. Spruill

*Assistant Examiner*—J. Reed Batten, Jr.

*Attorney, Agent, or Firm*—Schiller & Pandiscio

[57] ABSTRACT

A novel hot top mounting method is disclosed for use in attaching insulation to the upper interior portion of an ingot mold. The mounting method comprises (1) applying a plurality of thin steel mounting straps to the insulation and suspending the insulation in position adjacent to the upper interior surfaces of the mold, and (2) driving fasteners through the mounting straps and into the mold in order to securely fasten the insulation to the mold.

15 Claims, 4 Drawing Figures

ASSEMBLY AND METHOD OF ATTACHING TO INGOT MOLD

FIELD OF THE INVENTION

This invention relates to steel production in general, and more particularly to a novel system for attaching insulation to the upper interior portion of an ingot mold.

BACKGROUND OF THE INVENTION

Present methods of commercial steel production often call for taking the liquid metal of an initial steel melt and pouring it into large molds so as to cast giant ingots. These ingots may then be shipped and/or stored as desired. Later these giant ingots are remelted and the steel therefrom utilized in specific manufacturing operations. For obvious reasons, it is generally preferred that these ingots be formed substantially free of large voids.

It is well known in the industry that large voids will tend to appear in the ingots if premature solidification is allowed to take place about the upper edges of the mold while the metal in the center of the mold is still molten. As a result, steps are usually taken to stop this premature solidification. The most common method of preventing or reducing such premature solidification is to apply a liner of suitable insulation, generally available in the industry under such names as Hot-Top, Riser, etc., to the upper inside portion of the mold. This insulation then acts to prevent heat loss through the mold at its upper end, thereby assuring that the melt will not prematurely freeze on the mold.

One current method of attaching the insulation to the mold involves first suspending the insulation adjacent to the upper interior rim of the mold and then securing the insulation to the mold using nail-like fastening pins. The insulation may be suspended by hand in position prior to fastening or, as is more preferable due to the high mold temperatures involved and the great size of the molds, mechanical suspension systems may be employed. Such suspension systems are well known in the art and are exemplified in U.S. Pat. Nos. 3,797,801, 3,966,167, 3,506,236 and 4,083,528. While these mechanical suspension systems are generally satisfactory for suspending the insulation adjacent the interior rim of the mold, they have difficulty holding the insulation sufficiently tightly against the walls of the mold to insure that no molten steel can get in between the insulation and the mold and "float" the insulation away from the mold. Hence, the nail-like fastening pins are used to secure the insulation tightly to the mold walls.

One consequence of using fastening pins (and their attendant high-powered driving tools) to secure the insulation to the mold is that a washer must typically be deployed with each pin. More specifically, it has been found that in order to prevent the fastener from excessively penetrating the insulation, washers must be positioned between the head of the fastener and the insulation. This is necessary due to the relatively soft nature of the insulation material, the small bearing surface provided by the head of the fastener, and the relatively high driving power needed to set the fastener into the mold wall.

This need to deploy a washer with each fastener has lead to a number of difficulties. For example, where the fastening pins are being set by a driving tool which is not adapted to hold the washer prior to fastening, e.g., a tool such as the one disclosed in U.S. Pat. No. 4,040,554, an operator must manually position each washer between the driving tool and the workpieces. This manual washer positioning is usually quite slow and tiring, and can be inconvenient given the large size of the molds. In those tools adapted to receive and support a washer hand-loaded onto the tool prior to each fastening, e.g., a tool such as the one disclosed in U.S. patent application Ser. No. 964,955, now U.S. Pat. No. 4,227,637 issued Oct. 14, 1980, there still remains the problems of slow operation and added operator labor and fatigue. Finally, even in those tools which have a washer magazine and means for automatically deploying washers and fasteners together in response to the stimulating of a single trigger, e.g. a tool of the type disclosed in U.S. patent application Ser. No. 129,713, there still remains the problem of having to periodically reload the magazine with fresh washers. This reloading can involve considerable amounts of time given the design of some washer magazines.

Another problem associated with all hot top mounting systems which employ washers is that the cost of producing the washers can become significant when large numbers of washers are involved. In addition, the washers constitute another supply and inventory problem.

OBJECTS OF THE PRESENT INVENTION

As a result, the principal object of the present invention is to provide a hot top mounting system and method which does not require a washer to be deployed with every fastener, and yet will allow the usual insulation, fasteners and drivers to be used.

Another object is to provide a hot top mounting system which can make full use of fastener driving tools of the type disclosed in U.S. Pat. No. 4,040,554.

Still another object is to provide a hot top mounting system which offers a cheap, simple alternative to the use of washers.

SUMMARY OF THE INVENTION

These and other objects of the present invention are addressed by providing a hot top mounting system for use in attaching insulation to the upper interior portion of an ingot mold. The mounting system comprises thin steel mounting straps and involves (1) affixing a plurality of the mounting straps to the insulation prior to placing the insulation within the mold, (2) suspending the insulation in position adjacent the upper interior surfaces of the mold, and (3) driving fasteners through the mounting straps and into the mold in order to securely fasten the insulation to the mold.

BRIEF DESCRIPTION OF THE DRAWINGS

Still other features and objects of the present invention are more fully disclosed or rendered obvious in the following detailed description of the invention, which is to be considered together with the accompanying drawings wherein like numbers refer to like parts and wherein.

DETAILED DESCRIPTION OF THE INVENTION

Figure 1:
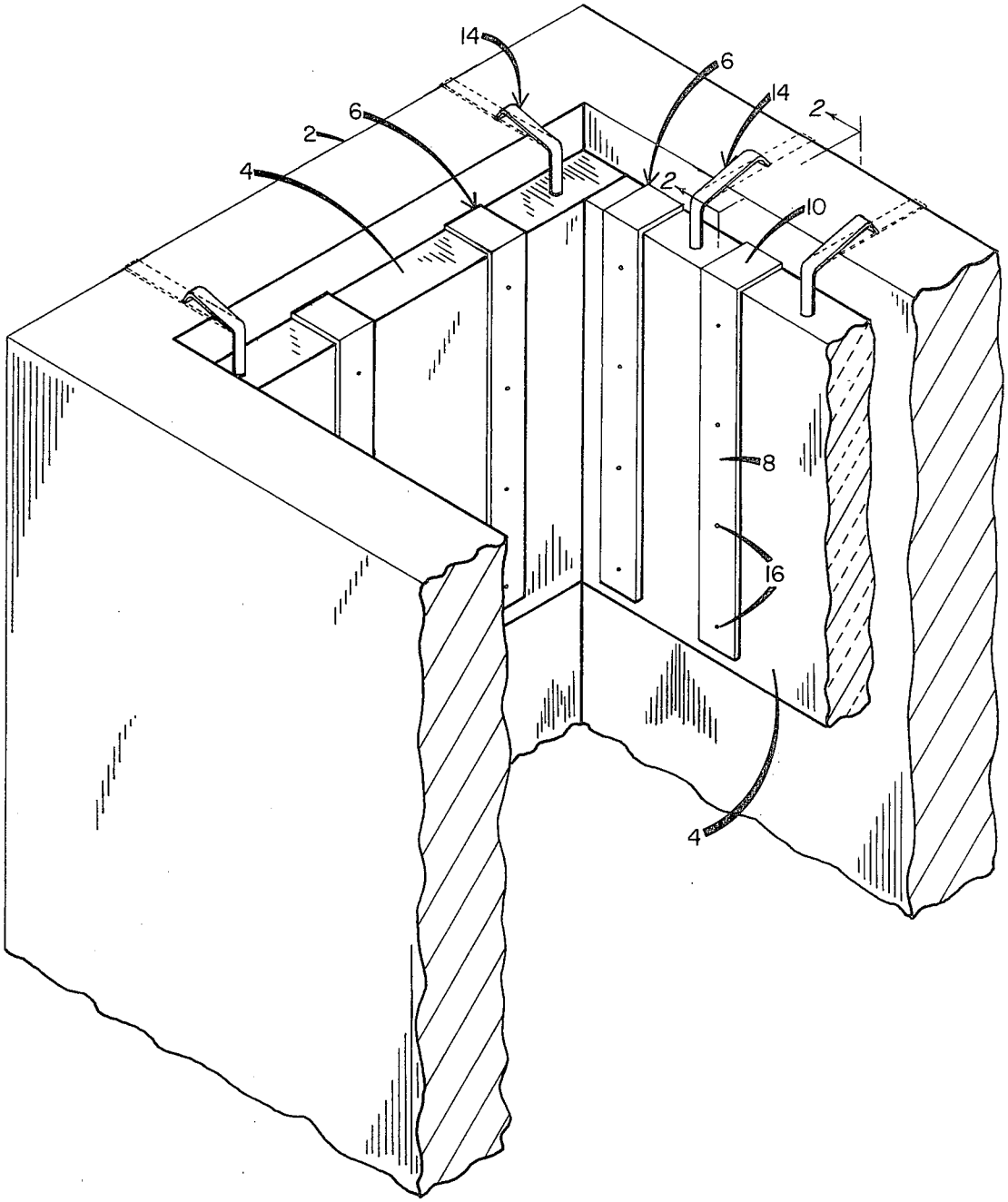
FIG. 1 is a perspective view of the top end of an ingot mold with portions broken away, showing a preferred embodiment of the hot top mounting system which comprises the present invention.
Figure 2:
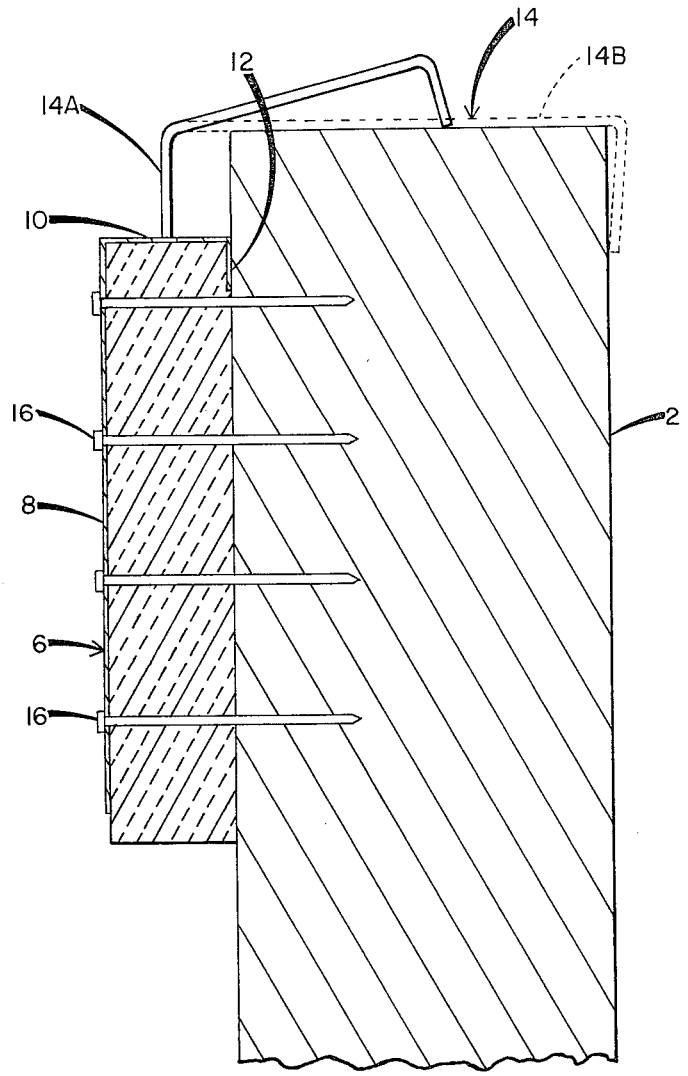
FIG. 2 is a side view taken along line 2—2 of FIG. 1, showing the mounting strap relative to the insulation and the mold wall.

Looking first to FIGS. 1 and 2, there is shown an open-topped metal mold 2 which is used in casting giant steel ingots. Mold 2 is typically of substantial size, e.g. interior dimensions of approximately 8 feet high, 2 feet wide, and 4 feet long. It is generally constructed of a metal such as cast steel according to methods well known in the industry.

Lining the upper interior portion of mold 2 is a plurality of insulation boards 4. As previously discussed, boards 4 serve to delay the melt's heat loss through the open end of mold 2 in order that the ingots will not be formed with substantial voids. Boards 4 are constructed of a suitable material, e.g., a heat and fire-resistant material such as asbestos, and are typically sized 12–14 inches high, 1–2 inches thick and 24 to 60 inches long.

The present invention comprises the means and methods by which insulation boards 4 are attached to mold 2. In general, boards 4 are fastened to mold 2 by means of a three-step process. First, a plurality of steel mounting straps are affixed to the insulation boards. Next, the boards (with their mounting straps attached) are suspended in position adjacent the upper interior surfaces of the mold. Finally, nail-like fastening pins are driven through the mounting straps and into the mold in order to securely fasten the insulation to the mold. Each of the aforementioned steps, and the parts associated therewith, will hereinafter be discussed in greater detail.

The first step of the mounting process involves preparing insulation boards 4. This essentially comprises attaching a plurality of steel mounting straps 6 to the boards. In the preferred embodiment shown in FIGS. 1 and 2, each strap 6 is formed from a single piece of sheet steel, e.g., 18–20 gauge steel, and comprises a body section 8, a top extension 10 extending at a right angle to body section 8, and a flange 12 extending at a right angle to top extension 10. Straps 6 are affixed to insulation boards 4 by fitting each strap on a board so that the strap's top extension 10 rests flush with the top surface of the board and body section 8 and flange 12 lie parallel to one another on opposite sides of the insulation board (see FIG. 2). It is preferred, in order that straps 6 may be positioned about boards 4 and yet remain in place, that members 8, 10 and 12 be sized so as to make a close sliding fit with the upper ends of boards 4. In any case, however, so long as the top extension 10 is reasonably related to the thickness of boards 4 the light construction of straps 6 will allow flanges 12 to be bent inwardly or outwardly as needed to assure proper mounting and attachment of the straps to the boards. It is also preferred, in order that the fastening pins will be sufficiently placed to assure proper fastening of the insulation to the mold, that the steel mounting strips be placed approximately one foot apart from one another along the length of the insulation board 4 and that a mounting strap be located within several inches of each end of an insulation board. Straps 6 are preferably formed about 2 inches wide, and body sections 8 extend substantially all the way to the bottom of boards 4 when top extensions 10 lie flat on the top ends of the boards.

Once mounting straps 6 are in place about insulation boards 4, the next step is to suspend boards 4 in position adjacent the upper interior surfaces of the mold. As discussed above, a number of different mechanical suspension systems are available for this purpose. Since the specific suspension system utilized does not form an essential feature of the present invention, the simplest form of suspension system will be described herein for the sake of convenience.

Still looking now to FIGS. 1 and 2, each insulation board 4 is provided with a plurality of suspension hangers 14. There are typically two suspension, hangers 14 per board. Hangers 14 are approximately the shape of an inverted J, with the long section 14A embedded securely in the insulation board and the hook end 14B extending upwards above the boards. As shown in FIGS. 1 and 2, boards 4 are suspended in position adjacent the upper interior surfaces of the mold by fitting the hook end 14B of hangers 14 up onto the top edge of mold 2. Optionally, as shown in phantom, the hangers 14 may be suspended in position by fitting the hook end 14B up over the top edge of mold 2. In either case, however, the sections 14A of hangers 14 have a length such as to assure proper positioning of insulation boards 4 with respect to mold 2. In addition, it is preferred that hangers 14 be formed of somewhat bendable material so that the fitting and retention of hangers 14 will be facilitated. Hangers 14 are preferably constructed from round rods bent to form, although they may also be made from long flattened bars of metal, as shown in FIGS. 1 and 2. In any case, however, the particular design features of the suspension hangers 14 do not form an essential part of the present invention.

It will be appreciated that while suspension hangers 14 are suitable for suspending the insulation boards about the top inner portion of mold 2, they are incapable of holding the boards 4 firmly against the mold walls to insure that none of the melt will get in between insulation boards 4 and the walls of mold 2. Thus, some further attachment of the insulation to the mold is required. For this purpose a driving tool is used to set a plurality of nail-like metal fasteners 16 through mounting straps 6 and into the walls of mold 2. Preferably the driving tool used is one similar to the tool shown in U.S. Pat. No. 4,040,554, except that it has a handle arrangement suitable for use in and around ingot molds of the size contemplated here. The fasteners 16 are driven through straps 6 and insulation boards 4 so as to penetrate the walls of mold 2. In the typical case the fasteners are long enough to extend about ⅜ inch into the mold walls. The heads of the fasteners 16 engage straps 6 and thus hold the insulation boards tight against the inner surfaces of the mold. By properly sizing and positioning straps 6 about boards 4, it is possible to assure that all the edges of boards 4 will be held securely in place and none of the melt will be able to get in between the insulation and the mold.

Figure 3:
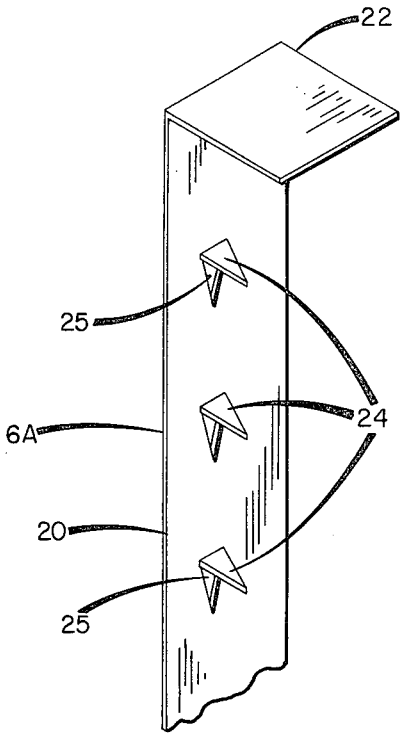
FIG. 3 is a perspective view showing an alternative form of mounting strap.

Shown in FIG. 3 is a modified form of mounting strap 6A. Strap 6A is provided with a body section 20 and a top extension 22 which correspond to similar parts on the previously-described mounting strap 6. Strap 6A, however, is provided with no counterpart to flange 12. Instead, it is provided with a series of sharp projecting tangs 24 which extend out of the plane of body section 20. Tangs 24 are formed by suitably punching body section 20 so as to leave openings 25. Straps 6A are mounted on boards 4 by forcing straps 6A towards the insulation boards so that projecting tangs 24 penetrate the boards and bind the straps to the boards. In this embodiment top extension 22 serves primarily to assure that straps 6A are not applied in a tilted manner, and also that the lower ends of the straps will not project significantly below the lower edges of the insulation boards.

Figure 4:
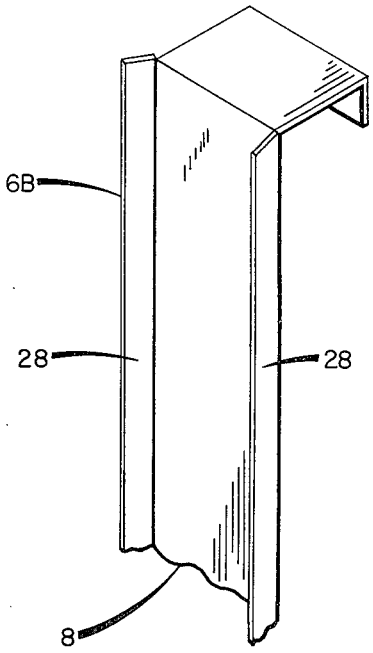
FIG. 4 is a perspective view showing yet another form of mounting strap.

Still another form of mounting strap 6B is shown in FIG. 4. Strap 6B is similar to the previous mounting strap 6 except that the strap is cut and bent so as to provide a pair of upraised surfaces 28 which run the length of the body section 8 of the strap. Surface 28 may extend at a right angle to body section 8 or may be at a different angle. The significant thing is that surfaces 28 and body section 8 define a channel of generally U-shaped cross-section. The channel is sized so as to receive the front nozzle of a fastener driving tool and the surfaces 28 serve to center the tool in position on strap 6B in order to facilitate the correct dispensing of fasteners into the body section 8 of the mounting strap. Upraised surfaces 28 preferably project ⅛ to ⅜ inches above the exposed surface of body section 8.

There are numerous advantages to using the present invention. First, it provides a system for mounting insulation to the upper interior surfaces of an ingot mold whereby a washer does not need to be deployed with every fastener. Second, the present system offers a cheap, simple alternative to the use of washers. Third, the present hot top mounting system is fully compatible with fastener driving tools of the type shown in U.S. Pat. No. 4,040,554. Fourth, the simple designs of the mounting straps allow scrap sheet metal to be used to fabricate the mounting straps. Such use of scrap metal helps lower the cost of producing the mounting straps.

Finally, it should be noted that the various embodiments illustrated and described herein are intended solely for the sake of example and clarity and should in no way be construed as limiting the scope of the present invention, since various alterations may be carried out on the illustrated embodiments without departing from the essential features of the invention. Thus, for example, one might use an insulation suspension system comprising hangers different than the hangers 14 shown in FIGS. 1 and 2. Or one might omit the top extension 22 of strap 6A. Alternatively, one might provide the mounting strap 6B with the sharp projecting tangs of mounting strap 6A. It is also conceived that one might form projecting tangs 24 in a shape other than triangular, e.g., rounded. A further contemplated modification is to replace the raised surfaces 28 with a bead formed by bending at each side portion of the strap. Another possible variation is to mount the straps 6, 6A or 6B to the insulation boards after the latter are hung from the mold by the hangers 14. Still another variation would be to form the strap 6A without the top extension 22, and with a reduced length. Then a number of these straps could be attached to an insulation board at various locations between its top, bottom and side edges so as to provide a more evenly distributed fastening pattern. Also such straps could be disposed so that they extend horizontally rather than vertically. These and other changes of their type are foreseen as obvious to one skilled in the art.

What is claimed is:

1. A method for attaching an insulation board to an upper interior surface of an ingot mold, said method comprising the following:

(a) attaching a plurality of mounting straps to an insulation board, each of said mounting straps having first, second and third flat portions, with said first portion extending parallel to said third portion and said second portion extending perpendicular to said first and third portions, and each of said mounting straps being attached to said insulation board so that said first portion extends parallel to the major plane of the insulation board adjacent to one of the two principal surfaces of that same board, said third portion extends parallel to the major plane of the insulation board adjacent to the other of the two principal surfaces of that same board, and said second portion rests atop said board;

(b) suspending said insulation board adjacent to an upper interior surface of an ingot mold by means independent of said mounting straps, with said board being suspended so that the major plane of the board lies parallel to said upper interior surface and the board is disposed between said first portions of the mounting straps and said upper interior surface; and (c) driving a plurality of fasteners through said first portions of said mounting straps and into said mold so as to fasten said insulation board to said mold.

2. A method according to claim 1 wherein said mounting straps are formed from a single piece of sheet metal, said sheet metal being bendable so as to allow slight adjustments in fit with said insulation board.

3. A method according to claim 1 wherein said first portion of said mounting strap extends substantially all the way down to the end of the insulation board when said second portion is contacting the top end of said board.

4. A method according to claim 1 wherein said first portion is provided with a U-shaped channel for centering the nose of a driving tool.

5. A method for attaching an insulation board to an upper interior surface of an ingot mold, said method comprising the following:

(a) attaching a plurality of mounting straps to an insulation board, each of said mounting straps having first and second flat portions extending perpendicularly to one another, with said first portion having at least one tang projecting from the plane of said first portion, and each of said mounting straps being attached to said insulation board so that said first portion extends parallel to the major plane of the insulation board adjacent to one of the two principal surfaces of that same board and said at least one tang projecting from the plane of said first portion penetrates into said insulation board, and said second portion rests atop said board;

(b) suspending said insulation board adjacent to an upper interior surface of an ingot mold by means independent of said mounting straps, with said board being suspended so that the major plane of the board lies parallel to said interior surface and the board is disposed between said first portions of the mounting straps and said upper interior surface; and (c) driving a plurality of fasteners through said first portions of said mounting straps and into said mold so as to fasten said insulation board to said mold.

6. A method according to claim 5 wherein said first portion of said mounting strap extends substantially all the way down to the end of the insulation board when said second portion is contacting the top end of said board.

7. A method according to claim 5 wherein said first portion is provided with a U-shaped channel for centering the nose of a driving tool.

8. An assembly for attachment to an interior surface of an ingot mold, said assembly comprising:

(1) an insulation board;

(2) suspension means connected to said insulation board for suspending said insulation board to an interior surface of an ingot mold; and (3) a plurality of mounting straps attached to said insulation board, each of said mounting straps comprising first, second and third portions wherein said third portion extends parallel to said first portion and said second portion extends perpendicular to said first and third portions, and further wherein said first and third portions extend on opposite sides of said board and said second portion sits atop said board, and each of said mounting straps being independent of said suspension means and being adapted to act as a bearing surface for nail-like fasteners set into said mounting straps, in order that the shanks of said nail-like fasteners may penetrate said mounting straps, said insulation board and said interior surface of said ingot mold while the heads of said nail-like fasteners will be caught and retained by said mounting straps.

9. The assembly according to claim 8 wherein each of said mounting straps is provided with a generally U-shaped channel on said first portion for centering the nose of a driving tool against said mounting strap.

10. An assembly for attachment to an upper interior surface of an ingot mold, said assembly comprising:

(1) an insulation board (2) suspension means connected to said insulation board for suspending said insulation board adjacent to an upper interior surface of an ingot mold; and (3) a plurality of mounting straps attached to said insulation board, each of said mounting straps comprising a first portion having at least one tang projecting therefrom and penetrating said insulation board, and a second portion extending perpendicular to said first portion, said first and second portions being sized so that said first portion extends along one side of the board with said at least one tang engaged with said board and said second portion extends along the top of said board, each of said mounting straps being independent of said suspension means and being adapted to act as a bearing surface for nail-like fasteners set into said mounting straps, in order that the shanks of said nail-like fasteners may penetrate said mounting straps, said insulation board and said interior surface of said ingot mold while the heads of said nail-like fasteners will be caught and retained by said mounting straps.

11. The assembly according to claim 10 wherein each of said mounting straps is provided with a generally U-shaped channel on said first portion for centering the nose of a driving tool against said mounting strap.

12. In combination with an insulation board and suspension means for suspending said insulation board from the upper end of an ingot mold so that said board lies against an interior surface of said mold, apparatus for attaching said board to said interior surface, said apparatus comprising at least one mounting strap adapted for attachment to said insulation board, said mounting strap being independent of said suspension means and comprising first, second and third portions arranged so that said first and third portions may extend on opposite sides of said board when said second portion sits atop said board, said first portion being adapted to act as a bearing surface for nail-like fasteners driven into said mounting strap in order that the shanks of said fasteners may penetrate said strap, said insulation board and said interior surface of said mold while the heads of said fasteners are intercepted and retained by said strap.

13. Apparatus according to claim 12 wherein said first portion is shaped to form a channel for centering the nose of a fastener-driving tool.

14. In combination with an insulation board and suspension means for suspending said board from the upper end of an ingot mold so that said board lies against an interior surface of said mold, apparatus for attaching said board to said interior surface, said apparatus comprising at least one mounting strap adapted for attachment to said board, said mounting strap comprising first and second angularly disposed portions arranged so that when said second portion extends along the top of said board said first portion may extend along one side of said board in position to act as a bearing surface for nail-like fasteners driven into said strap, in order that the shanks of said nail-like fasteners may penetrate said strap, said board and said interior surface of said mold while the heads of said fasteners will be intercepted and retained by said first portion of said mounting strap, said first portion also having at least one tang projecting therefrom and adapted to penetrate into said board when said strap is pressed against said board.

15. Apparatus according to claim 14 wherein said first portion of said strap is shaped to form a channel for centering the nose of a fastener-driving tool.

* * * * *

UNITED STATES PATENT AND TRADEMARK OFFICE

CERTIFICATE OF CORRECTION

PATENT NO. : 4,330,922

DATED : May 25, 1982

INVENTOR(S) : Harry M. Haytayan

It is certified that error appears in the above-identified patent and that said Letters Patent are hereby corrected as shown below:

Claim 8, column 7, line 5, the word "adjacent" should be inserted before the word "to".

Signed and Sealed this

*Twenty-fourth* Day of *August 1982*

[SEAL]

*Attest:*

GERALD J. MOSSINGHOFF

*Attesting Officer*

*Commissioner of Patents and Trademarks*